US006412921B1

(12) United States Patent
Manini

(10) Patent No.: US 6,412,921 B1
(45) Date of Patent: Jul. 2, 2002

(54) INK JET PRINTHEAD

(75) Inventor: Enrico Manini, Chiaverano (IT)

(73) Assignee: Olivetti Tecnost S.p.A., Ivrea (IT)

( * ) Notice: Subject to any disclaimer, the term of this patent is extended or adjusted under 35 U.S.C. 154(b) by 0 days.

(21) Appl. No.: 09/720,734

(22) PCT Filed: Jun. 25, 1999

(86) PCT No.: PCT/IT99/00187

§ 371 (c)(1),
(2), (4) Date: Dec. 29, 2000

(87) PCT Pub. No.: WO00/00354

PCT Pub. Date: Jan. 6, 2000

(30) Foreign Application Priority Data

Jun. 29, 1998 (IT) ..... TO98A0562

(51) Int. Cl.[7] ..... B41J 2/05; B41J 2/21
(52) U.S. Cl. ..... 347/65; 347/43
(58) Field of Search ..... 347/44, 47, 63, 347/65, 40, 43, 42, 67

(56) References Cited

U.S. PATENT DOCUMENTS 5,308,442 A 5/1994 Taub et al. ..... 216/27
5,371,531 A * 12/1994 Rezanka et al. ..... 347/43
5,387,314 A * 2/1995 Baughman et al. ..... 347/63
5,402,162 A * 3/1995 Fusting et al. ..... 347/43
5,463,412 A * 10/1995 Matsuda ..... 347/43

FOREIGN PATENT DOCUMENTS

EP 401.996 12/1990 ..... B41J/2/05
EP 764533 3/1997 ..... B41J/2/16
EP 771658 5/1997 ..... B41J/2/16

* cited by examiner

*Primary Examiner*—John Barlow
*Assistant Examiner*—Juanita Stephens
(74) *Attorney, Agent, or Firm*—Banner & Witcoff, Ltd.

(57) ABSTRACT

An ink jet printhead optimally utilizes the surface area of the upper face of a silicon die, even in the case of a non-monochromatic head having plural ink tanks. For each tank of ink, the ink includes one pass-through slot that departs from the lower face of the silicon die and terminates in a wider trench in the upper face. The pass-through slot is made using a chemical etching type incision technique known as "inductively coupled plasma" (ICP), thus maximizing the distance between the different ink tanks and, simultaneously, minimizing the distance between the different groups of nozzles on the upper face of the die. Accordingly, the risk of the silicon substrate breaking during any of the various stages of manufacture is considerably reduced.

16 Claims, 4 Drawing Sheets

INK JET PRINTHEAD

TECHNOLOGICAL AREA OF THE INVENTION

This invention relates generically to ink jet printheads and, in particular but not exclusively, to the thin-film heads employing the thermal ink jet printing technology, called "top-shooters", i.e. those in which the drop of ink is emitted in a direction perpendicular to the emission chamber, which accommodates the resistor that, when heated, generates the vapor bubble that ultimately results in emission of the drop.

THE PRIOR ART

Ink jet printheads of the type described above, both monochromatic and colour, are widely known in the sector art and comprise an actuator assembly, typically consisting of:

- a silicon chip or die, on the upper face of which various layers are deposited using known technologies to form the emission resistors and the interconnections, and upon which active electronic components, the MOS transistors driving the emission resistors, for example, are made;
- a layer of a photopolymer, overlaid on the upper face of the silicon die, in which the emission chambers disposed in correspondence with the emission resistors and the ink ducts are made using known photolithographic technologies; and
- a nozzles plate, overlaid on the layer of photopolymer, in which the nozzles through which the ink drops are emitted are made in correspondence with the emission chambers, using known technologies.

It is equally widely known that the ink jet printheads of the type described above comprise an ink tank, attached to the lower face of the silicon die, and that the feeding of the ink from the tank to the above-mentioned ducts and emission chambers is effected through a pass-through slot, made in the center of the silicon die, for example by way of a sandblasted cut. Typically the silicon die is rectangular shape, and the emission resistors, the emission chambers and the nozzles are arranged in two rows parallel to the greater side of the rectangle and on two opposite sides of the central slot. The slot is typically oblong shape and of an overall length slightly less than that of the greater side of the rectangle, in order to be able to feed the ink uniformly to all the emission chambers.

The fact of having the slot means that the silicon die is mechanically weaker, and this increased fragility is the cause of breaks both during the cutting of the slot itself and during the subsequent steps in manufacturing the heads, all the more so the greater the number of nozzles in the head and, consequently, the longer the greater side of the silicon die. Unfortunately, today's technology tends to produce heads with an ever greater number of nozzles, as this enables printing times to be reduced and the printer's throughput to be accordingly enhanced.

One way of solving the problem of satisfying these contrasting requirements is that illustrated in the U.S. Pat. No. 5,317,346, wherein the pass-through slot for feeding of the ink is divided into a certain number of shorter pass-through slots, all in a line parallel to the greater side of the silicon die and in the center thereof, and finishing in a single trench made in the upper face of the silicon die itself The shape of the trench is symmetrically mirrored in an analogous cavity formed in the photopolymer, from which the channels conveying the ink and the emission chambers depart.

Accordingly the feeding of the ink from the tank to the emission chambers is effected through a duct consisting of the combination of a slot made in the silicon die (for example, by means of cut performed by sandblasting) starting from the latter's lower face, and a trench, again in the silicon die, made by means of a chemical etching process starting from the upper face of the die. The latter process is, for example, described in a second U.S. Pat. No. 5,387,314, granted to the same assignee as the previous one and related thereto, wherein the process is specified to be a dry etching process, known to those acquainted with the sector art and based on the use of $CF_4+O_2$, $SF_6$ or a mixture of noble gases and fluorocarbon compounds.

In practice, however, it has been verified that the methodology illustrated, though valid from a strictly theoretical viewpoint, cannot be used for the production on an industrial scale (i.e. with low times and costs) of a trench on the upper face of the silicon die having the required depth, i.e. 25÷100 $\mu$m.

There is also a second problem, in addition to that of the fragility of the silicon die, that is not solved in the patents cited but which is very much present in the sector art: this problem is that of succeeding in using optimally the surface area of the upper face of the die in the case of a colour printhead, or at any rate of a non-monochromatic one.

It is well-known, in fact, that colour heads typically comprise three distinct groups of nozzles, each connected to and fed from a tank containing a different colour ink (generally cyan, magenta and yellow) through a separate pass-through slot made in the usual silicon die; the three groups of nozzles are reciprocally aligned in a direction parallel to the greater side of the rectangle of the silicon die and, in turn, the nozzles of each group are arranged in two rows, each parallel to the greater side of the rectangular silicon die, as in the case of the monochromatic heads.

In order to prevent adjacent nozzles belonging to different colour groups reciprocally "polluting" each other and also to permit a suitable physical separation between the different tanks of ink, the three groups of nozzles are set apart by a distance typically equal to approximately 30 elementary steps of $1/600^{th}$ of an inch (=1.27 mm; the $300^{th}$ and the $600^{th}$ of an inch are units of measure widely used throughout this sector of the art), with the result that a non negligible area of the silicon die remains unused and the cost of the actuator assembly is increased.

Whereas the problem of the reciprocal "pollution" between adjacent nozzles belonging to different colour groups could be resolved by setting the three groups of nozzles apart by only 10÷15 elementary steps of $1/600^{th}$ of an inch (≈0.4÷0.6 mm), the tolerances on positional precision of the sealing elements between the tanks, however, mean that a physical separation must be maintained between the different ink tanks, such that the distance between adjacent groups of nozzles cannot be less than the value cited above of approximately 30 elementary steps of $1/600^{th}$ of an inch, leaving unresolved the problem of optimal use of the die surface area.

SUMMARY OF THE INVENTION

The object of this invention is to define an ink jet printhead that enables optimal use to be made of the surface area of the upper face of the silicon die, including in the case of a non-monochromatic head having numerous different ink tanks. For each tank of ink, the head according to the invention has one pass-through slot that departs from the lower face of the silicon die and finishes in a wider trench made in the upper face, made using a chemical etching type incision technique known as ICP (Inductively Coupled Plasma), thereby maximizing the distance between the tanks of the different inks and, at the same time, maximizing the distance between the different groups of nozzles on the upper face of the die. An additional advantage is that the head according to this invention considerably lowers the risk of the silicon substrate breaking during the various stages of manufacture.

A further object of the invention is that of defining an ink jet printhead manufacturing process that enables the cost of the actuator assembly to be reduced, optimizing utilization of the surface area on the upper face of the silicon die, including in the case of color printheads with tanks of different colored inks, and cutting down on the number of manufacturing rejects due to breaks in the silicon substrates through the production of a pass-through slot starting from the lower face of the die and flowing into a wider trench made in the upper face using an ICP chemical etching type incision technique.

The above objects are obtained by means of an ink jet printhead and relative manufacturing process, characterized as defined in the main claims.

These and other objects, characteristics and advantages of this invention will be apparent from the description that follows of the preferred embodiment, provided purely by way of an illustrative, non-restrictive example, and with reference to the accompanying drawings.

LIST OF FIGURES

DESCRIPTION OF THE PREFERRED EMBODIMENT

Figure 1:
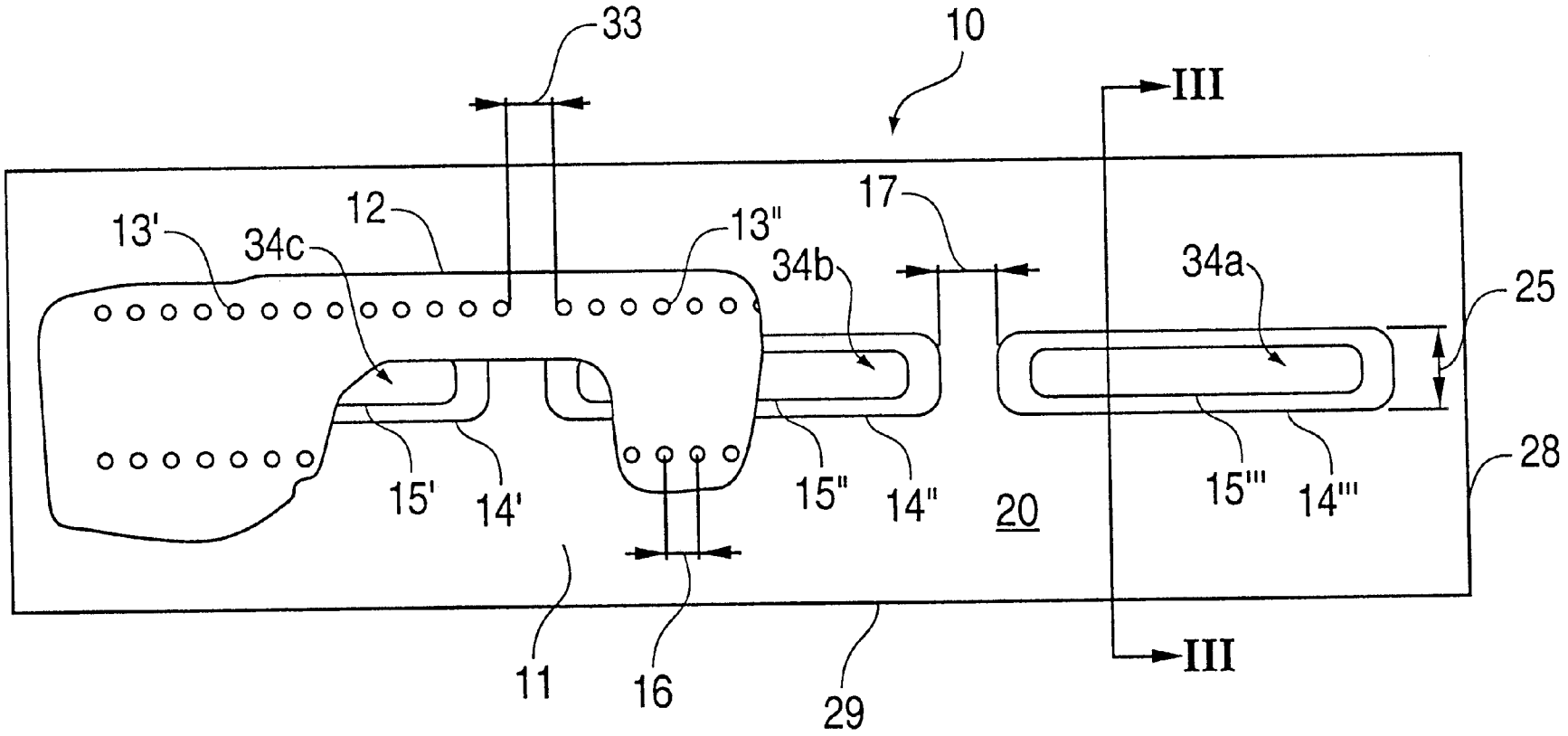
FIG. 1 is a schematic representation of a partial plan view, not drawn to scale, of the upper face of the actuator assembly of a colour ink jet printhead according to the invention.

FIG. 1 is a partial plan view, not drawn to scale, of the upper face of an actuator assembly 10 of a color ink jet printhead according to the invention, in which a nozzle plate 12 provided with a plurality of nozzles 13 for the emission of ink droplets, typically numbering between 100 and 500, and disposed according to a step 16, for example equal to $1/300^{th}$ of an inch (≈0.085 mm), and an underlying layer (12*a*) of photopolymer, not visible in FIG. 1 (but visible in FIG. 3), provided with ink conveying channels and emission chambers, has been partially removed to show an upper face 20 of a rectangular-shaped silicon die 11, having a greater side 29 and a lesser side 28. The nozzles 13 are arranged in three groups, 13', 13" and 13'" (not shown), separated by a distance 33.

Three distinct slots 15', 15" and 15'", have been made in the silicon die 11, finishing in three corresponding trenches 14', 14" and 14'". The three slots 15', 15" and 15'" are arranged in the center of the die 11 aligned along a direction parallel to the greater side 29 of the substrate 11 itself.

Figure 2:
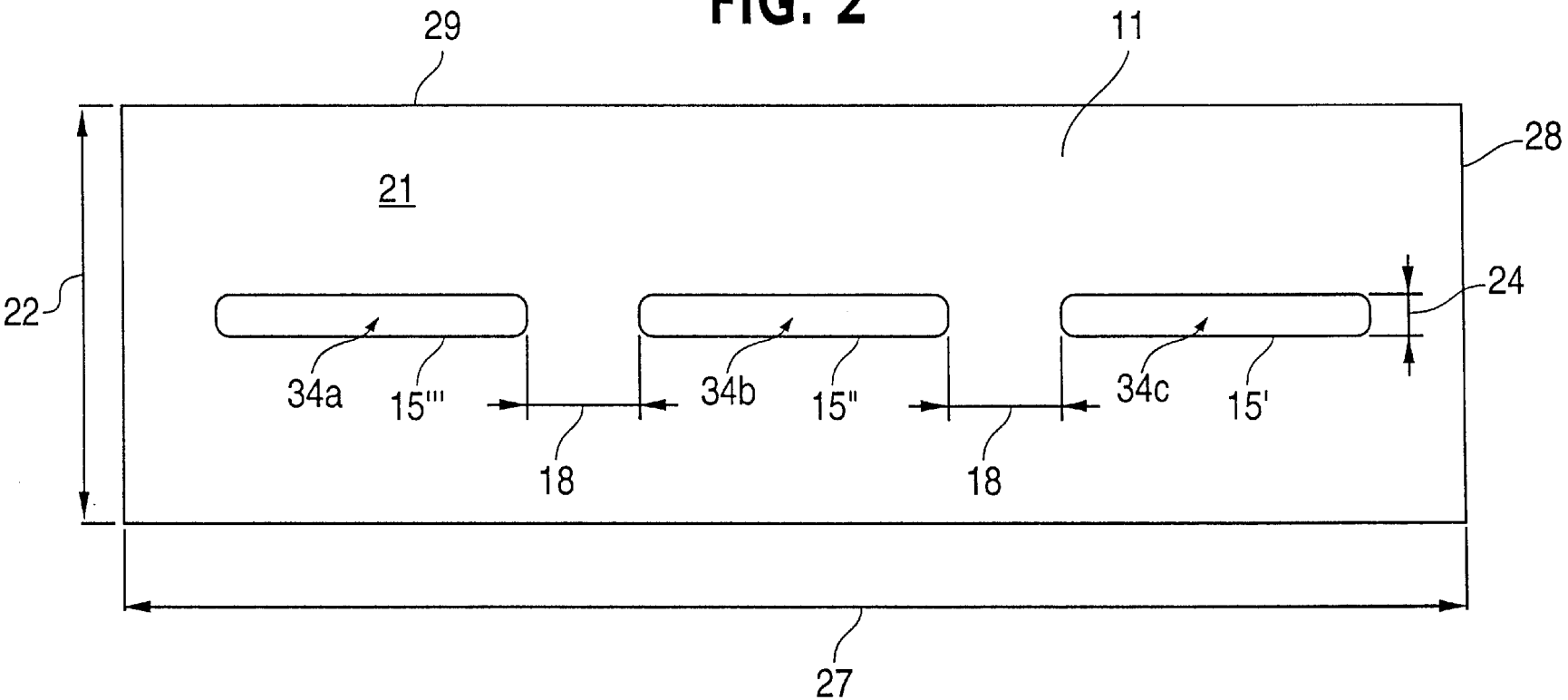
FIG. 2 is a schematic representation of a partial plan view, not drawn to scale, of the lower face of the actuator assembly of a colour ink jet printhead according to the invention.

A lower face 21 of the silicon die 11 is illustrated in FIG. 2 the greater side 29 of the silicon die 11 is of a length 27 typically between 10 and 30 mm, and the lesser side 28 is of a length 22 typically between 3 and 5 mm; the slots 15', 15" and 15'" are arranged at a first relative distance 18 from each other, measured on the lower face 21, typically equal to 25÷35 steps of $1/600^{th}$ of an inch (=1.06÷1.48 mm), and are of first width 24 equal, for example, to $4/300^{th}$ of an inch (≈0.34 mm).

The trenches 14', 14" and 14'" are arranged concentrically with respect to the corresponding slots 15', 15" and 15'" at a second relative distance 17 from each other, measured on the upper face 20, typically of 10÷15 steps of $1/600^{th}$ of an inch (≈0.42÷0.64 mm), and are of a second width 25 equal, for example, to $5/300^{th}$ of an inch (≈0.42 mm)

Figure 3:
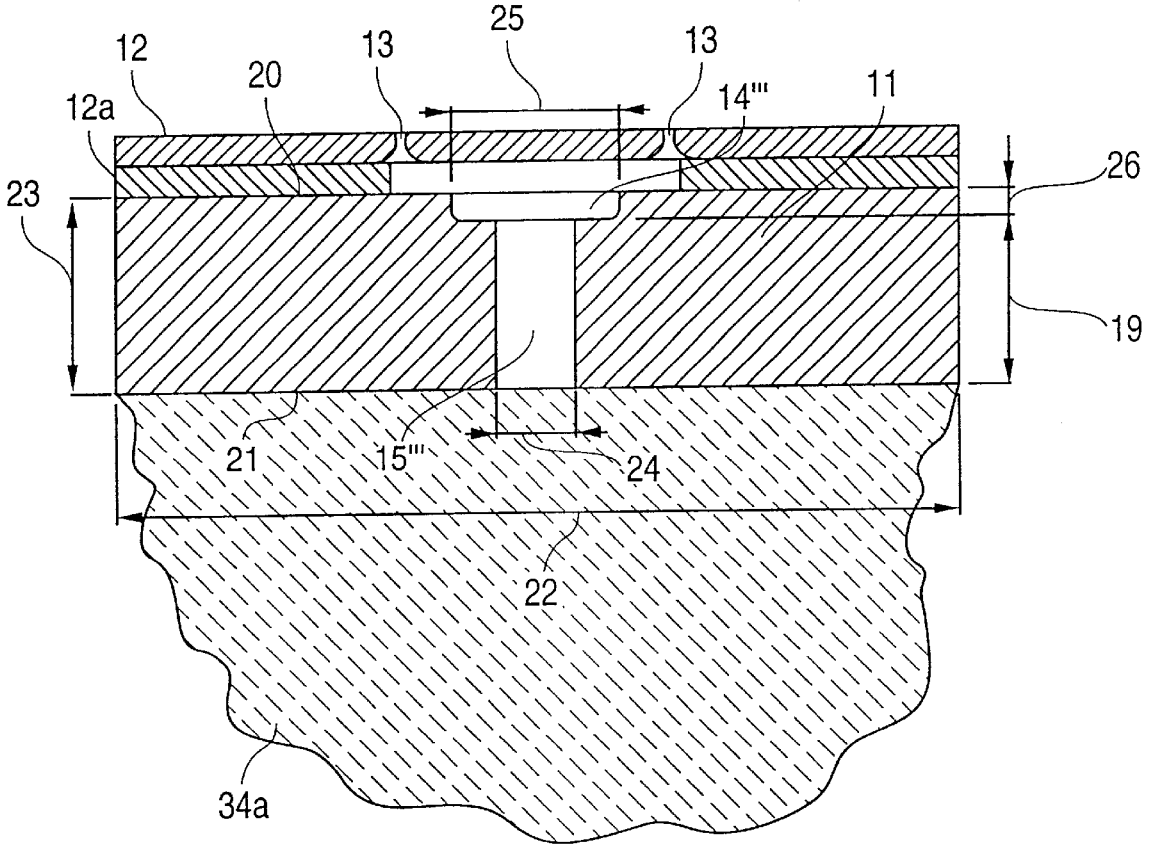
FIG. 3 is a schematic representation of a section view, not drawn to scale, of the silicon die of the actuator assembly of a colour ink jet printhead according to the invention.

A transverse section of the die 11 along the direction III—III is illustrated in FIG. 3. The die 11 has a thickness 23 typically between 0.4 and 0.8 mm, preferably equal to 0.625 mm; in the latter case, the slot 15'" has a first depth 19 typically between 300 and 775 μm, preferably equal to approx. 575 μm, and the trench 14'" has a second depth 26 typically between 25 and 100 μm, preferably equal to about 50 μm.

Figure 4:
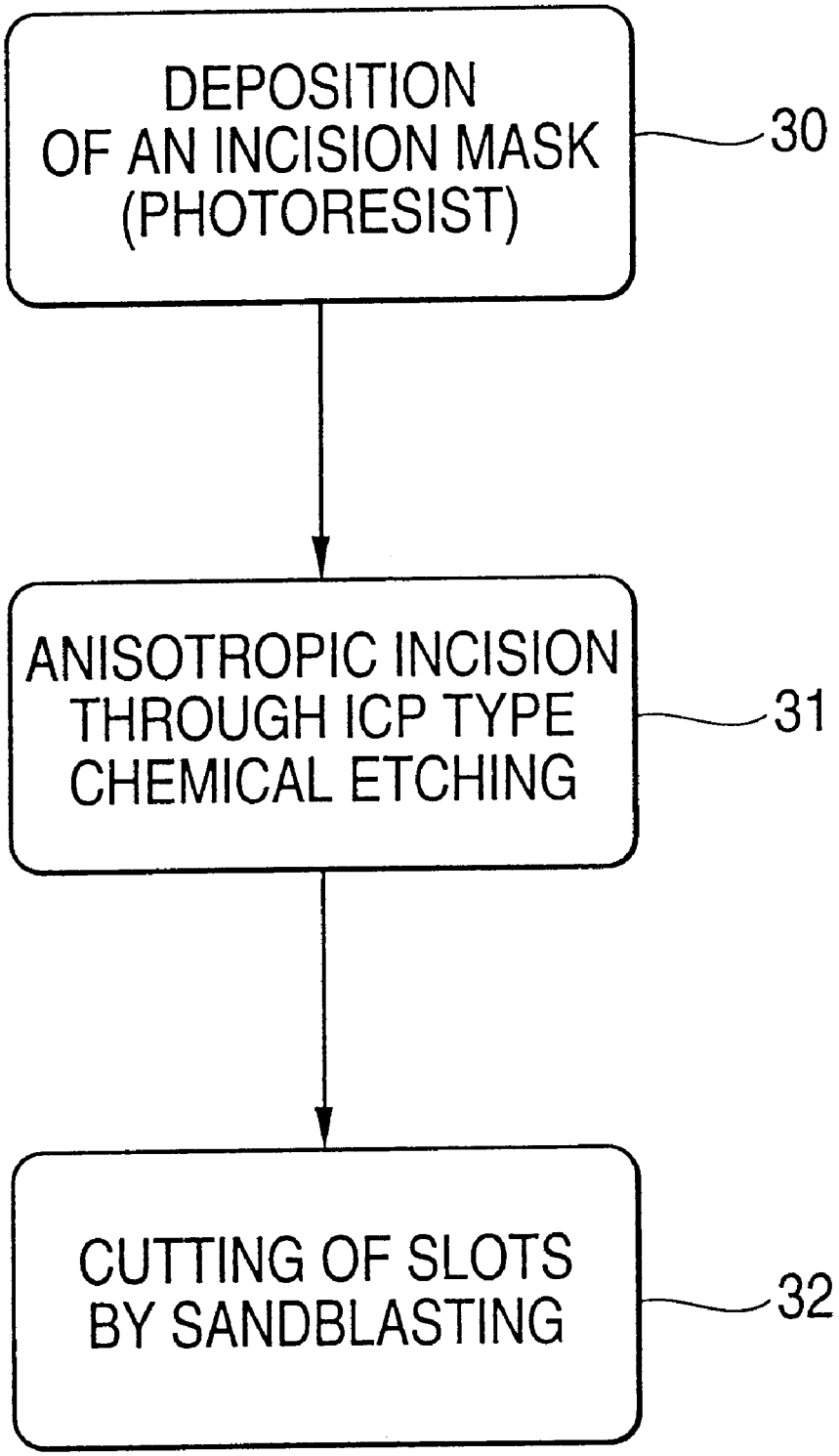
FIG. 4 is a schematic representation of the flow diagram of the process of production of the slots, and trenches in the die of an actuator assembly of a colour ink jet printhead according to the invention.

With reference to FIG. 4, the method will now be described for producing the slots 15', 15" and 15'" and the trenches 14', 14" and 14'" starting from the silicon die 11, on whose upper face 20 both the deposition of the various layers forming the emission resistors and the interconnections, and also the integration of the active electronic components, the MOS transistors driving the emission resistors, for example, have already been performed, using known techniques.

A first step 30 of the process consists in the depositing on the upper face 20 of the silicon die 11 of an etching mask, in the form of a known type photoresist layer, which leaves the zones of the die 11 corresponding to the areas of the trenches 14', 14" and 14'" free; a second step 31 of the process consists in making an anisotropic incision by chemical etching of the areas of the trenches 14', 14' and 14'" not protected by the photoresist according to an ICP (Inductively Coupled Plasma) technique, well known to those acquainted with the sector art, the precise details of which are not described herein as they are abundantly described in the U.S. Pat. No. 5,501,893, a third step 32 of the process consists in making the slots 15', 15" and 15'" by means of cutting performed by sandblasting, a known type of operation, done starting from the lower face 21 of the die 11.

The duct consisting of the slot+trench combination thus obtained has the double advantage, firstly of leaving a considerable first relative distance 18 on the lower face 21 of the die 11 between the tanks with the different colour inks, thus avoiding the problem of a lack of precision in positioning of the sealing elements between the tanks, while at the same time endowing the die 11 with considerable mechanical strength, and secondly of leaving a reduced second relative distance 17 on the upper face 20 of the die 11, so that the amount of space remaining unused between the adjacent groups of nozzles 13 is kept to within very reduced limits.

Naturally changes may be made to the invention described above, without departing from the scope of the invention.

For example, the slots 15', 15" and 15'" could be made in the third step 32 of the process by way of an anisotropic incision through chemical etching, according to the same ICP technique as applied to the lower face 21 of the die 11 in the second step 31, after application of a suitable photoresist type protective mask as in the first step 30, leaving exposed the areas destined for the slots 15', 15" and 15'" themselves.

Or again, "isles" or "posts" could be made in the second step of the process described earlier inside the areas of the trenches 14', 14" and 14'" surrounding the corresponding slots 15', 15" and 15'", having the function, as will be known to those acquainted with the sector art, of trapping any impurities or air bubbles contained in the ink, thus preventing these from compromising functional operativity of the nozzles.

Another possibility, instead of making the slots 15', 15" and 15'", would be to make a series of circular holes in their place, of diameter 0.3 mm for example, aligned in a direction parallel to the greater side 29 of the silicon die 11 and arranged at a step typically of between 1 and 1.5 mm.

Finally, before the second step 31 of the process, a sacrificial layer of silicon on the upper face 20, of depth 50 $\mu$m for example, could be made porous in the zone where the anisotropic incision by chemical etching is performed, in order to accelerate the latter operation.

What is claimed is:

1. An ink jet printhead, comprising:

an actuator assembly (10) including a silicon die (11) having an upper face (20), a lower face (21) and a thickness (23); a layer (12*a*) deposited on said upper face (20) of said silicon die (11); and a nozzle plate (12) adhering to said layer (12*a*) on a side opposite to that of said silicon die (11), said nozzle plate (12) having at least a first group of nozzles (13') and a second group of nozzles (13") separated by a distance (33); and at least two tanks of ink attached to said lower face (21) of said silicon die (11), a first tank (34*a*) of said two tanks containing a first ink in fluid communication with said first group of nozzles (13') through a first duct made in said thickness of said die (11), and a second tank containing a second ink in fluid communication with said second group of nozzles (13") through a second duct made in said thickness of said die (11), characterized in that said first duct comprises a first slot (15') that departs from said lower face (21) of said die (11) and terminates in a first trench (14') made on said upper face (20) of said die (11), and that said second duct comprises a second slot (15") that departs from said lower face (21) of said-die (11) and terminates in a second trench (14") made on said upper face (20) of said die (11), and wherein said first and second trenches (14', and 14") in said upper face (20) of said die (11) are arranged in front of said nozzle plate (12) in order to convey the ink coming from said first and second slots (15', 15") towards the zones respectively of said first and of said second group of nozzles (13', 13"), a first distance (18) between said first slot (15') and said second slot (15") on said lower face (21) of said die (11) being greater than a second distance (17) between said first trench (14') and said second trench (14") on said upper face (20) of said die (11), wherein the distance (33) between said first group of nozzles (13') and said second group of nozzles (13"), along said nozzle plate (12), is less than the distance between said first slot (15') and said second slot (15").

2. Printhead according to claim 1, characterized in that said first trench (14') and said second trench (14") are made on said upper face (20) of said die (11) by means of anisotropic incision through an inductively coupled plasma type chemical etching.

3. Printhead according to claim 2, characterized in that said first slot (15') and said second slot (15") are made in said thickness of said die (11) by means of cutting performed by sandblasting.

4. Printhead according to claim 2, characterized in that said first slot (15') and said second slot (15") are made in said thickness (23) of said die (11) by means of anisotropic incision through an inductively coupled plasma type chemical etching.

5. Printhead according to claim 2, characterized in that said first trench (14') and said second trench (14") inside contain at least one slot (15) made by means of said anisotropic incision operation through an inductively coupled plasma type chemical etching.

6. Printhead according to claim 1, wherein said first trench (14') and said second trench (14") possess a depth (26), characterized in-that said depth is between 25 and 100 $\mu$m.

7. Printhead according to claim 1, characterized in that said first distance (18) between said first slot (15') and said second slot (15") on said lower face (21) of said die (11) is between 1058 $\mu$m ($^{25}/_{600}{}_{th}$ of an inch) and 1482 $\mu$m ($^{35}/_{600}{}^{th}$ of an inch), and said second distance (17) between said first trench (14") and said second trench (14") on said upper face (20) of said die (11) is between 423 $\mu$m ($^{10}/_{600}{}^{th}$ of an inch) and 635 $\mu$m ($^{15}/_{600}{}^{th}$ of an inch).

8. Printhead according to claim 7, characterized in that said distance (33) separating said first group of nozzles (13') and said second group of nozzles (13") is substantially equal to said second distance (17) between said first trench (14') and said second trench (14") on said upper face (20) of said die (11).

9. Printhead according to claim 1, wherein said silicon die (11) is rectangular shape with a greater side (29) and a lesser side (28), characterized in that said greater side (29) is between 10 and 30 mm long and said lesser side (28) between 3 and 5 mm long.

10. Printhead according to claim 9, characterized in that said thickness (23) of said silicon die (11) is between 0.4 and 0.8 mm.

11. Printhead according to claim 9, characterized in that said first group of nozzles (13') and said second group of nozzles (13") are arranged in two rows parallel to said greater side (29).

12. Printhead according to claim 1, characterized in that said first ink differs from said second ink by its colour.

13. Printhead according to claim 12, also comprising a third group of nozzles (13'") in fluid communication with a third tank of ink (34*c*) containing a third ink, characterized in that said first ink is a cyan color ink, said second ink is a magenta color ink and said third ink is a yellow color ink.

14. Printhead according to claim 1, characterized in that said first ink differs from said second ink by having a different drying speed.

15. Printhead according to claim 1, characterized in that said first slot (15') and said second slot (15") are rectangular in shape with a lesser side (24) having a length of 340 $\mu$m ($^{4}/_{300}{}^{th}$ of an inch).

16. Printhead according to claim 15, characterized in that said first trench (14') and said second trench (14") are rectangular in shape with a lesser side (25) of length equal to 423 $\mu$m ($^{5}/_{300}{}^{th}$ of an inch) and are arranged concentrically around respectively said first slot (15') and said second slot (15").

* * * * *